United States Patent [19]

Füssner

[11] Patent Number: 4,516,730

[45] Date of Patent: May 14, 1985

[54] FUEL INJECTION NOZZLE FOR INTERNAL COMBUSTION ENGINES

[75] Inventor: Paul Füssner, Sindelfingen, Fed. Rep. of Germany

[73] Assignee: Robert Bosch GmbH, Stuttgart, Fed. Rep. of Germany

[21] Appl. No.: 491,640

[22] Filed: May 5, 1983

[30] Foreign Application Priority Data

Jul. 28, 1982 [DE] Fed. Rep. of Germany ..... 3228079

[51] Int. Cl.[3] ..... F02M 47/02

[52] U.S. Cl. ..... 239/533.8

[58] Field of Search ..... 239/533.8, 533.3, 585, 239/88, 90–92, 533.4, 533.5; 251/44

[56] References Cited

U.S. PATENT DOCUMENTS 4,205,789 6/1980 Raufeisen ..... 239/533.3
4,215,821 8/1980 Eblen ..... 239/533.8 X

FOREIGN PATENT DOCUMENTS 2755222 12/1977 Fed. Rep. of Germany ... 239/533.8
476891 12/1952 Italy ..... 239/533.3
165760 12/1981 Japan ..... 239/533.3

*Primary Examiner*—Andres Kashnikow
*Assistant Examiner*—Kevin Patrick Weldon
*Attorney, Agent, or Firm*—Edwin E. Greigg

[57] ABSTRACT

A fuel injection nozzle for internal combustion engines is proposed which has a stepped piston which converts a medium pressure in the fuel inflow line into high pressure in accordance with the ratio between its piston surface areas. The stepped piston and the high-pressure chamber are disposed to surround the valve needle in accordance with the invention, resulting in a space-saving embodiment. The closing spring of the valve needle can be advantageously accommodated in the high-pressure chamber and can simultaneously act as the return spring for the stepped piston so that a separate part for that purpose can be dispensed with.

13 Claims, 3 Drawing Figures

18
30
hg
38
20
19
34
31
37
33
36
32
40
29
24
42
41
II
43
28
44
II
22
25
26
11
12
16
10
17
15
14

41
16
43
40
26
44
10
12

FUEL INJECTION NOZZLE FOR INTERNAL COMBUSTION ENGINES

BACKGROUND OF THE INVENTION

The invention is based on a fuel injection nozzle as revealed in the ensuing specification. Injection nozzles of this general type have the advantage that the injection pump and the pressure lines leading to the injection nozzles can be designed for low pressures, because the high pressure required for injection is generated in the injection nozzles themselves. As a result of the overflow valve between the medium-pressure and high-pressure chambers in the injection nozzle, the quantity of fuel required for the next injection event passes into the high-pressure chamber as the stepped piston returns following the closure of the injection valve. In a known injection nozzle of this general type (German Offenlegungsschrift No. 27 55 222), the stepped piston and its high-pressure chamber are disposed upstream of the valve needle; the high-pressure chamber is formed in a cylindrical part inserted into the spring chamber of the nozzle housing. This embodiment requires an additional part, and depending on the embodiment of the return spring for the stepped piston may also require additional space in the axial direction of the injection nozzle.

Another known embodiment of an injection nozzle with a stepped piston (German Pat. No. 492 378) does not have a valve needle; instead, it has a valve which opens in the flow direction of the fuel, and the spherical closing member of the valve is caught along with its closing spring in a widening of the fuel conduit formed between the valve seat and the injection port. In still another known injection nozzle, which has a valve needle and is used for both preliminary and primary injection (German Offenlegungsschrift No. 15 76 478), a preliminary injection piston is embodied as a stepped piston, which is disposed laterally beside the valve needle and runs up against a stop, after which the primary injection quantity reaches the pressure shoulder of the valve needle via a bypass around the stepped piston. This embodiment would necessitate a relatively large diameter of the nozzle housing if, as in an injection nozzle of the general type discussed initially above, the stepped piston were embodied as a pressure-translating element having an effect over the entire injection stroke.

OBJECT AND SUMMARY OF THE INVENTION

The apparatus according to the invention has the advantage over the prior art that the stepped piston does not significantly increase either the length or the diameter of the nozzle housing and that it can furthermore be disposed directly in one of the two parts of a nozzle housing which in conventional fashion comprises a nozzle body and a nozzle holder, thus eliminating one additional part for forming the cylinder for the high-pressure chamber.

By means of the characteristics disclosed, advantageous further embodiments of the apparatus disclosed in the main claim are attainable.

It is particularly advantageous in that the valve needle, has a pressure shoulder in the vicinity of the medum-pressure chamber. As a result, the remnant pressure remaining in the medium-pressure chamber following the drop of the injection pressure below the closing pressure reinforces the closing force of the closing spring.

An embodiment which is particularly compact and has very few parts is attained if a common return or closing spring is assigned to both the stepped piston and the valve needle, the spring being located in the high-pressure chamber and supported on one end on the stepped piston and on the other end on a shoulder of the valve needle.

If the stepped piston is made up of two piston parts of different diameter disposed axially one after the other, the positional tolerances of the two housing bores receiving the stepped piston do not have to be so close.

The overflow valve between the medium-pressure and high-pressure chambers of the stepped piston functions perfectly if it is disposed not in the reciprocating stepped piston itself but rather in a stationary housing part.

The disposition of the stepped piston according to the injection can advantageously be provided in injection nozzles having clearly defined preliminary and primary injection phases as well if the injection nozzle is provided with two valve needles, the first of which is embodied as a hollow needle surrounding and guiding the second valve needle. In this case, the return spring of the stepped piston surround the piston part having the smaller diameter, and the closing springs of the two valve needles are disposed in a housing chamber disposed upstream of the medium-pressure chamber.

The invention will be better understood and further objects and advantages thereof will become more apparent from the ensuing detailed description of the two preferred embodiments taken in conjunction with the drawings.

DESCRIPTION OF THE PREFERRED EMBODIMENTS

Figure 1:
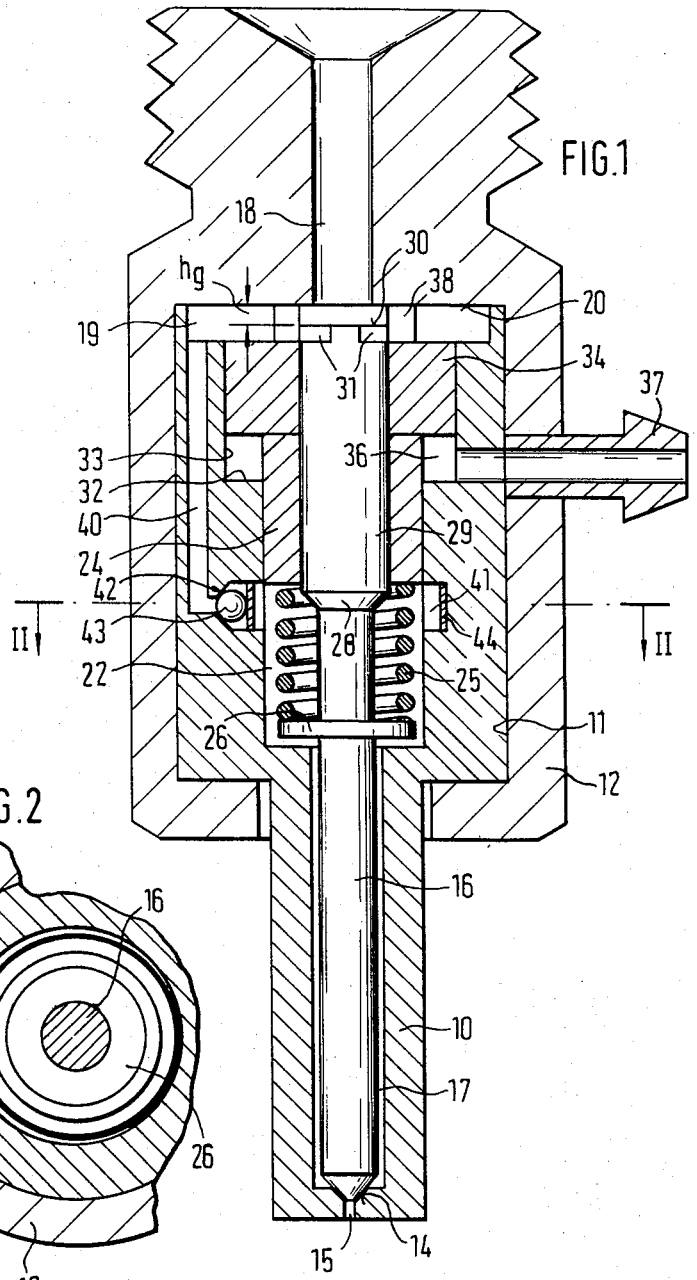
FIG. 1 is a longitudinal section taken through the first exemplary embodiment.
Figure 2:
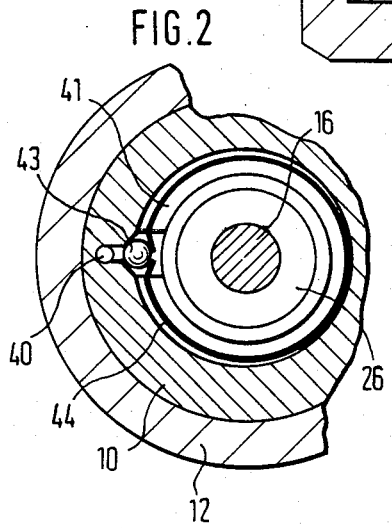
FIG. 2 is a section taken along the line II—II of FIG. 1.

The injection nozzle shown in FIG. 1 has a nozzle body 10 which is secured in a bore 11 of a nozzle holder 12. A valve seat 14 is formed in the nozzle body 10 upstream of an injection port 15, and a valve needle 16 is displaceably disposed in a bore 17, relative to the valve seat 14. The nozzle holder 12 has a fuel inlet bore 18, which leads into a medium-pressure chamber 19 formed between the end face of the nozzle body 10 and the end face 20 of the bore 11 in the nozzle holder 12 and the upper face of medium pressure piston 34.

The bore 17 in the nozzle body 10 joins with a high-pressure chamber 22, which is defined at the top by a face of a displaceably supported high-pressure piston 24. A closing spring 25 is disposed in the high-pressure chamber 22 and is supported at the top by the chamber defining face of the high-pressure piston 24 and at the bottom on a collar 26 rigidly secured to the valve needle 16 in chamber 22. In the vicinity of the high-pressure chamber 22, the valve needle 16 has a pressure shoulder 28, which is adjoined by an end section 29 of the valve needle having a larger diameter. This end section 29 centrally penetrates the high-pressure piston 24 and is displaceably guided therein with the least possible play.

The end section 29 of value needle 16 is defined by an end face 30, which in the illustrated closing position of the valve needle 16 is remote from the bore end face 20 by a distance $h_g$ corresponding to the total stroke. At the flat end, the valve needle 16 is provided with a plurality of peripheral recesses 31, which in the illustrated valve needle position at the end of the stroke enables the fuel to flow out of the inlet bore 18.

The bore wall of the nozzle body 10 surrounding the high-pressure chamber 22 merges at a shoulder 32 with a bore section 33 of increased diameter, which leads as far as the upper end face of the nozzle body 10. In the bore section 33, a medium-pressure piston 34 likewise centrally penetrated by the valve needle 16 is guided with the least possible play, and its diameter in the pressure translation ratio is greater than the diameter of the high-pressure piston 24. The medium-pressure piston 34 rests upon one face of the high-pressure piston 24; the plane of separation between the two pistons 24, 34 is, in every position of the pistons, located some distance above the shoulder 32. The annular chamber 36 formed between the bottom face of piston 34 and shoulder 32 communicates continuously with a leakage oil outlet 37.

On its upper end face defined by the medium-pressure chamber 19, the medium-pressure piston 34 is provided with individual protrusions 38, which limit the upward movement of the return stroke of the two pistons 24, 34 brought about by the closing spring 25. From the medium-pressure chamber 19, a passage 40 leads into an annular groove 41 in nozzle body 10, which surrounds the high-pressure chamber 22 in the vicinity of piston 24 and is not entirely covered by the high-pressure piston 24, even in the position of this piston 24 at the end of the stroke. The mouth of the passage 40 which leads into the annular groove 41 is monitored by a discharge valve 42, the closing member 43 of which, embodied as a ball, is pressed radially against the valve seat 42 by an annular spring 44 located in the annular groove 41.

OPERATION

The injection nozzle described above functions as follows:

At the beginning of an injection event, fuel at medium pressure passes through the inlet bore 18 into the medium-pressure chamber 19 and from there travels via the passage 40 and the discharge valve 42 into the high-pressure chamber 22. After the high-pressure chamber 22 is filled, the fuel pressure in the medium-pressure chamber 19 increases until the pistons 24, 34 move downward counter to the force of the closing spring 25. The pressure in the high-pressure chamber 22 is thereby increased at a selected translation ratio with respect to the inlet pressure. The high pressure thus resulting is exerted upon the high pressure shoulder 28 of the valve needle 16 and raises this needle upward, counter to the effective medium pressure in the medium-pressure chamber 19. The injection port 15 is thereby uncovered, so that the fuel can flow out of the high-pressure chamber 22 along the annular gap in the bore 17 thereby reducing the pressure in high pressure chamber 22.

Once the fuel pressure in chamber 22 drops below the closing pressure, the valve needle 16 closes, and the pistons 24, 34 are returned to the illustrated starting position by means of the closing spring 25; fuel flows via the overflow valve 42 into the high-pressure chamber 22. The remnant pressure in the lines and in the medium-pressure chamber 19 reinforces medium-pressure chamber 19 reinforces the closing force of the closing spring 25. The leakage oil reaching the annular chamber 36 is removed via the leakage oil connection 37.

As a result of the disposition of the two pistons 24, 34 on the valve needle 16, a compact embodiment of the injection nozzle is attained, and by disposing the closing spring 25 in the high-pressure chamber 22, an additional return spring for the pistons 24, 34 is dispensed with. Because of the two-part embodiment of the stepped piston, the positional tolerances of the cylindrical guide face in the nozzle body 10 need not be so close, and the costs of manufacture can be reduced accordingly. As a result of the disposition of the overflow valve 42 in a stationary housing part, the valve can operate perfectly without being affected by the oscillations of the pistons 24, 34.

Figure 3:
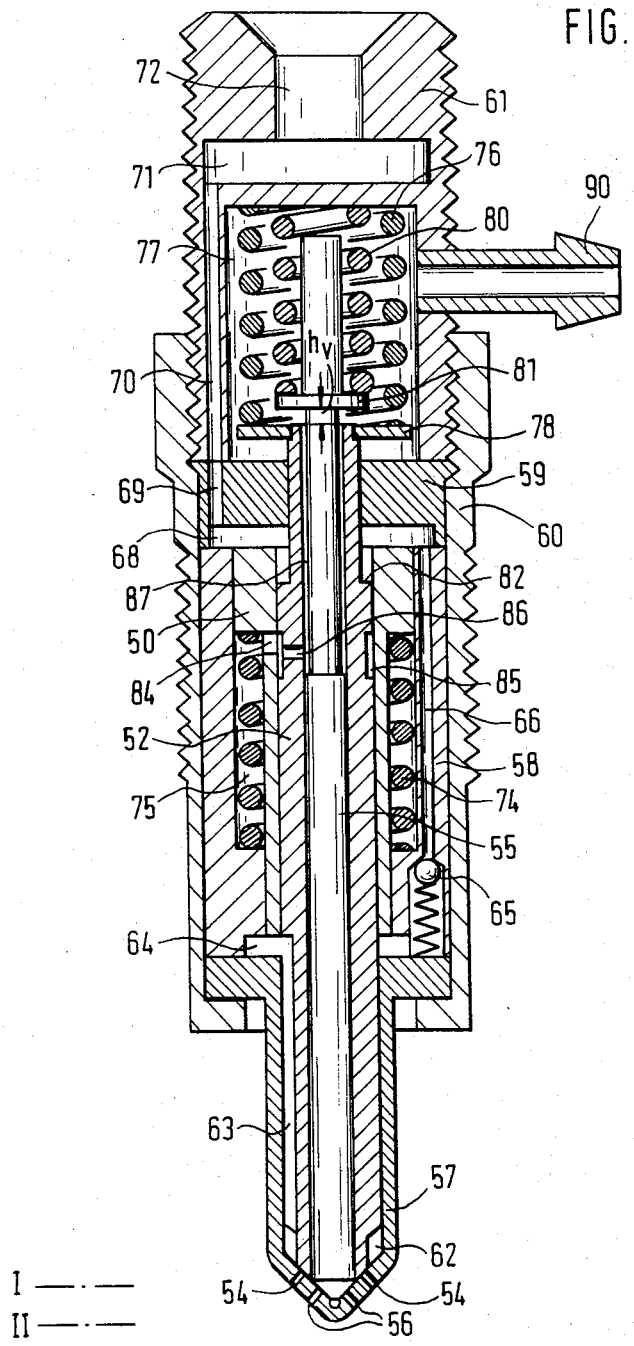
FIG. 3 is a longitudinal section taken through the second exemplary embodiment.

The injection nozzle of FIG. 3 has a one-part stepped piston 50, which surrounds a hollow needle 52 that functions relative to a first injection cross section I formed by injection ports 54. A second valve needle 55 is displaceably supported in the hollow needle 52 and functions relative to a second injection cross section II formed by injection ports 56. The injection ports 54 and 56 are embodied in a nozzle body 57, which is secured in place by a bushing 58 and an intermediate disc 59 which are firmly clamped in place relative to a nozzle holder 61 by a sleeve nut 60. A presure chamber 62 is formed in hollow needle 52 relative to the nozzle body 57 and communicates via a longitudinal groove 63 in the hollow needle 52 with a high-pressure chamber 64 formed between the nozzle body 57 and the bushing 58., The high-pressure chamber 64 is defined by the smaller piston surface area of the stepped piston 50 and communicates via an overflow valve 65 and a lateral passage 66 with a medium-pressure chamber 68, which is formed between one end of the bushing 58 and the intermediate disc 59 and defined by the larger piston surface area of the stepped piston 50.

From the medium-pressure chamber 68, corresponding bores 69 and 70 in the intermediate disc 59 and the nozzle holder 61 lead into a chamber 71, into which an inflow bore 72 in the nozzle holder 61 discharges.

The stepped piston 50 has a return spring 74, which is disposed in a cylindrical chamber 75 of the bushing 58 surrounding the smaller piston section of the stepped piston 50, which applies a force on the larger piston section of the stepped piston 50. The hollow needle 52 is provided with the stepped piston 50. The hollow needle 52 is provided with a closing spring 76, which is accommodated in a spring chamber 77 formed within the nozzle holder 61 with the spring supported both on the upper face of this chamber 77 and on a disc 78 connected with and supported on the upper end of the hollow needle 52. A second closing spring 80 is disposed in the spring chamber 77 and associated with the valve needle 55 and supported both on the upper face of the spring chamber 77 and on an annular collar 81, in the illustrated closing position of the hollow needle 52 and valve needle 55, is remote from the end face of the hollow needle 52 by a distance $h_v$ corresponding to a predetermined preliminary stroke. The hollow needle 52 is provided in the vicinity of the medium-pressure chamber 68 with an annular shoulder 82, upon which the inlet pressure of the fuel is exterted upon the hollow needle 52 in the closing direction.

The cylindrical chamber 75 communicates via a transverse bore 84 in the stepped piston 50, an annular groove 85 and a transverse bore 86 in the hollow needle 52 with an annular chamber spacing 87 between the hollow needle 52 and a reduced diameter section of the valve needle 55. This annular chamber spacing 87 leads into the spring chamber 77, which communicates with a leakage oil outlet connection 90.

The incoming supply pressure in the medium-pressure chamber 68 via chamber 77 and passage 70 is exerted on the large piston surface area of the stepped piston 50. At the same time, the fuel pressure in the high-pressure chamber 64 and in the pressure chamber 62 is increased with the smaller piston surface area of the stepped piston 50 in accordance with the effective ratio between the two areas. The high pressure is exerted on the annular shoulder of the hollow needle 52 that defines the pressure chamber 62 and raises this needle 52 counter to the force of its closing spring 76, so that a preliminary injection quantity is ejected through the injection cross section I with the high pressure then prevailing.

After the attainment of the preliminary stroke $h_v$, the fuel pressure must increase still more sharply, until via the annular collar 81 and after a certain time delay, the valve needle 55 is raised counter to the closing spring 80, whereupon the primary injection quantity is injected through the injection cross sections I and II, likewise at high pressure. Upon the attainment of the end of injection, the fuel pressure in the medium-pressure chamber 68 drops. At the same time, the stepped piston is returned by the return spring 74; the hollow needle is returned by the closing spring 76; and the valve needle 55 is returned by the closing spring 80, all to their illustrated starting positions. During this process, first the injection cross section I is closed by the closing spring 76 and by the pressure forces in the medium-pressure chamber 68, and only thereafter is the injection cross section II blocked off by the valve needle 55. During the closure process of the two injection cross sections I and II, fuel flows from the medium-pressure chamber 68 via the overflow valve 65 into the high-pressure chamber 64 for the next injection event. the pressure in the lines or, in other words, the remnant pressure between the injection events reinforces the closing action of the hollow needle 52 and the valve needle 55. The resultant leakage oil is removed via the leakage oil outlet connection 90.

The coupled movement of the valve needle 55 effected by means of the hollow needle 52 following a given preliminary stroke $h_v$ could also be effected by means of a transverse pin, for example, which is disposed in the valve needle 55 in the vicinity of the return spring 74 for the stepped piston 50 and which engages a correspondingly larger-dimensioned transverse bore in the hollow needle 52. The play between the coupling pin and the larger transverse bore in the hollow needle 52 can in this case also serve to remove leakage oil from the cylinder chamber 75 to the spring chamber 77.

The foregoing relates to preferred exemplary embodiments of the invention, it being understood that other embodiments and variants thereof are possible within the spirit and scope of the invention, the latter being defined by the appended claims.

What is claimed and desired to be secured by Letters Patent of the United States is:

1. A fuel injection nozzle for internal combustion engines having a housing and further comprising a stepped piston acted upon by a spring means, said piston including a larger piston surface area and a smaller piston area, said larger piston surface area defining a medium-pressure chamber communicating with a fuel inlet connection and the smaller piston surface area defining a high-pressure chamber formed directly in said housing, said high-pressure chamber arranged to communicate with the medium-pressure chamber via an overflow valve opening counter to a high pressure, and a valve needle means disposed coaxially within the stepped piston and the high-pressure chamber, which valve needle means is loaded by said spring means, said valve needle means monitoring at least one injection port communicating with the high-pressure chamber and has a high-pressure shoulder which is engaged by the high fuel pressure such as to effect opening.

2. A fuel injection nozzle according to claim 1, in which said spring means comprises a common spring that functions relative to both the stepped piston and the valve needle, which common spring is located in the high-pressure chamber and supported on one end on the stepped piston and on an opposite end on a shoulder of the valve needle.

3. A fuel injection nozzle according to claim 1, in which the stepped piston comprises two piston parts of different diameters disposed axially one after the other.

4. A fuel injection nozzle according to claim 1, in which the valve needle means also has an end-face in the vicinity of the medium-pressure chamber.

5. A fuel injection nozzle according to claim 4, in which said spring means comprises a common spring that functions relative to both the stepped piston and the valve needle, which spring is located in the high-pressure chamber and supported on one end on the stepped piston and on an opposite end on a shoulder of the valve needle.

6. A fuel injection nozzle according to claim 1, in which the valve needle means comprises first and second valve needles, the first of which is embodied as a hollow needle which surrounds and guides the second valve needle, and said spring means comprises a piston return spring surrounding the part of said stepped piston having the smaller diameter and closing springs acting on the first and second valve needles, said closing springs being accommodated in a spring chamber disposed upstream of the medium-pressure chamber.

7. A fuel injection nozzle according to claim 6, in which the cylindrical chamber receiving the return spring of the stepped piston communicates via openings in the stepped piston and in the first valve needle and via a longitudinal conduit between the first and second valve needles with the spring chamber receiving the closing springs which spring chamber has a leakage oil connection.

8. A fuel injection nozzle according to claim 1, in which the overflow valve is disposed between the medium-pressure chamber and the high-pressure chamber in a stationary housing part including a cylindrical wall.

9. A fuel injection nozzle according to claim 8, in which the valve needle means comprises first and second valve needles, the first of which is embodied as a hollow needle which surrounds and guides the second valve needle, and said spring means comprises a piston return spring surrounding the part of said stepped piston having the smaller diameter and closing springs acting on the first and second valve needles, said closing springs being accommodated in a spring chamber disposed upstream of the medium-pressure chamber.

10. A fuel injection nozzle according to claim 9, in which the cylindrical chamber receiving the return spring of the stepped piston communicates via openings in the stepped piston and in the first valve needle and via a longitudinal conduit between the first and second valve needles with the spring chamber receiving the closing springs which spring chamber has a leakage oil connection.

11. A fuel injection nozzle according to claim 8, in which an annular groove is provided in the cylindrical wall of the stationary housing part surrounding the high-pressure chamber, into which groove an overflow conduit leading from the medium-pressure chamber discharges and which receives an annular spring element which presses a valve closing member against a mouth of the overflow conduit into the annular groove.

12. A fuel injection nozzle according to claim 11, in which the valve needle means comprises first and second valve needles, the first of which is embodied as a hollow needle which surrounds and guides the second valve needle, and said spring means comprises a piston return spring surrounding the part of said stepped piston having the smaller diameter and closing springs acting on the first and second valve needles, said closing springs being accommodated in a spring chamber disposed upstream of the medium-pressure chamber.

13. A fuel injection nozzle according to claim 12, in which the cylindrical chamber receiving the return spring of the stepped piston communicates via openings in the stepped piston and in the first valve needle and via a longitudinal conduit between the first and second valve needles with the spring chamber receiving the closing springs which spring chamber has a leakage oil connection.

* * * * *